US010215048B2

(12) United States Patent
McCaffrey et al.

(10) Patent No.: US 10,215,048 B2
(45) Date of Patent: Feb. 26, 2019

(54) VARIABLE AREA VANE ARRANGEMENT FOR A TURBINE ENGINE

(71) Applicant: United Technologies Corporation, Hartford, CT (US)

(72) Inventors: Michael G. McCaffrey, Windsor, CT (US); Raymond Surace, Newington, CT (US); Tracy A. Propheter-Hinckley, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 754 days.

(21) Appl. No.: 14/762,302

(22) PCT Filed: Jan. 21, 2013

(86) PCT No.: PCT/US2013/022411
§ 371 (c)(1),
(2) Date: Jul. 21, 2015

(87) PCT Pub. No.: WO2014/113039
PCT Pub. Date: Jul. 24, 2014

(65) Prior Publication Data

US 2015/0361822 A1 Dec. 17, 2015

(51) Int. Cl.
*F01D 17/16* (2006.01)
*F01D 5/14* (2006.01)
*F01D 5/18* (2006.01)

(52) U.S. Cl.
CPC ..... *F01D 17/162* (2013.01); *F01D 5/145* (2013.01); *F01D 5/187* (2013.01)

(58) Field of Classification Search
CPC ..... F01D 17/162; F01D 5/145; F01D 17/16; F01D 5/185; F01D 5/186; F01D 5/187
USPC ..... 415/159
See application file for complete search history.

(56) References Cited

U.S. PATENT DOCUMENTS

| | | | |
|---|---|---|---|
| 3,558,237 | A | 1/1971 | Wall, Jr. |
| 4,193,738 | A | 3/1980 | Landis et al. |
| 4,314,791 | A | 2/1982 | Weiler |
| 4,498,291 | A | 2/1985 | Jeffery |
| 5,184,459 | A | 2/1993 | McAndrews |
| 5,573,378 | A | 11/1996 | Barcza |
| 5,931,636 | A | 8/1999 | Savage et al. |
| 6,146,093 | A | 11/2000 | Lammas et al. |
| 6,210,106 | B1 | 4/2001 | Hawkins |
| 6,481,960 | B2 | 11/2002 | Bowen |
| 7,588,416 | B2 | 9/2009 | Bouru |
| 7,722,318 | B2 | 5/2010 | Addis |
| 7,845,906 | B2 | 12/2010 | Spangler et al. |

(Continued)

OTHER PUBLICATIONS

EP Search Report dated Feb. 4, 2016.

*Primary Examiner* — Mark Laurenzi
*Assistant Examiner* — Mickey France
(74) *Attorney, Agent, or Firm* — O'Shea Getz P.C.

(57) ABSTRACT

An adjustable stator vane for a turbine engine includes a shaft, a flange and a stator vane body that pivots about a variable vane axis. The stator vane body extends axially between a first end and a second end. The stator vane body includes an airfoil, a cavity, and a body surface located at the first end. The cavity extends axially from an inlet in the body surface and into the airfoil. The shaft extends along the variable vane axis from the first end. The flange extends circumferentially around the inlet and the shaft, and radially from the stator vane body.

19 Claims, 5 Drawing Sheets

(56) References Cited

U.S. PATENT DOCUMENTS

| | | | |
|---|---|---|---|
| 7,857,588 | B2 | 12/2010 | Propheter-Hinckley et al. |
| 8,007,229 | B2 | 8/2011 | McCaffrey et al. |
| 8,105,019 | B2 | 1/2012 | McCaffrey et al. |
| 8,182,208 | B2 | 3/2012 | Bridges, Jr. et al. |
| 8,171,978 | B2 | 5/2012 | Propheter-Hinckley et al. |
| 8,202,043 | B2 | 6/2012 | McCaffrey |
| 8,328,512 | B2 | 12/2012 | Major et al. |
| 2008/0031730 | A1 | 2/2008 | Houradou et al. |
| 2009/0097966 | A1 | 4/2009 | McCaffrey |
| 2009/0148282 | A1 | 6/2009 | McCaffrey |
| 2010/0202873 | A1 | 8/2010 | Andrew |
| 2011/0262274 | A1 | 10/2011 | Boy et al. |

VARIABLE AREA VANE ARRANGEMENT FOR A TURBINE ENGINE

This invention was made with government support under Contract No. N00014-09-D-0821 awarded by the United States Navy. The government may have certain rights in the invention.

This application claims priority to PCT Patent Application No. PCT/US13/22411 filed Jan. 21, 2013, which is hereby incorporated by reference.

BACKGROUND OF THE INVENTION

1. Technical Field

This disclosure relates generally to a turbine engine and, more particularly, to a variable area vane arrangement for a turbine engine.

2. Background Information

A typical turbine engine includes a fan section, a compressor section, a combustor section and a turbine section. The turbine engine may also include a plurality of variable area vane arrangements. Each variable area vane arrangement may guide and/or adjust a flow of core gas in one or more turbine stages. Alternatively, the variable area vane arrangement may guide and/or adjust the flow of core gas between an upstream engine section and an adjacent downstream engine section.

A typical variable area vane arrangement includes a plurality of adjustable stator vanes that extend between a radial outer vane platform and a radial inner vane platform. An outer radial end of each stator vane is rotatably connected to the outer vane platform with an outer shaft and a bearing. An inner radial end of each stator vane is rotatably connected to the inner vane platform with an inner shaft and a bearing. The outer shaft may include a bore that directs cooling air from a plenum, adjacent the outer vane platform, into a cavity within an airfoil of the respective stator vane. Airfoil cooling apertures may subsequently direct the cooling air out of the cavity to film cool the outer surfaces of the airfoil that are exposed to the core gas. To provide a sufficient quantity of the cooling air, the outer shaft bore typically has a relatively large diameter. As the diameter of the outer shaft bore increases, however, the size of the bearing also increases, which may increase the weight, cost and complexity of the vane arrangement.

There is a need in the art for an improved variable area vane arrangement.

SUMMARY OF THE DISCLOSURE

According to an aspect of the invention, an adjustable stator vane is provided for a turbine engine. The adjustable stator vane includes a shaft, a flange and a stator vane body that pivots about a variable vane axis. The stator vane body extends axially between a first end and a second end. The stator vane body includes an airfoil, a body surface and a cavity. The body surface is located at the first end. The cavity extends axially from an inlet in the body surface and into the airfoil. The shaft extends along the variable vane axis from the first end. The flange extends circumferentially around the inlet and the shaft, and radially from the stator vane body.

According to another aspect of the invention, another adjustable stator vane is provided for a turbine engine. The adjustable stator vane includes a shaft, a flange and a stator vane body that pivots about a variable vane axis. The stator vane body extends axially between a first end and a second end, and includes an airfoil. The shaft is connected to the stator vane body at the first end, and extends along the variable vane axis. The flange is connected to the stator vane body at the first end. The flange extends circumferentially around the shaft, and radially from the stator vane body. The flange is axially separated from a surface of the airfoil by a gap.

According to still another aspect of the invention, a variable area vane arrangement is provided that includes a vane first platform, a vane second platform and an adjustable stator vane that pivots about a variable vane axis. The adjustable stator vane includes a stator vane body, a first shaft, a second shaft and a flange. The stator vane body extends axially at least partially into a vane aperture of the first platform, and between a first end and a second end. The stator vane body includes an airfoil that is arranged between the first platform and the second platform. The first shaft extends along the variable vane axis from the first end, and is rotatably connected to the first platform. The second shaft extends along the variable vane axis from the second end, and is rotatably connected to the second platform. The flange extends circumferentially around the first shaft, and radially from the stator vane body.

The first end may be a vane outer end and the second end may be a vane inner end. Alternatively, the first end may be a vane inner end and the second end may be a vane outer end.

The stator vane body may include a body surface and a cavity. The body surface may be located at the first end. The cavity may extend axially from an inlet in the body surface and into the airfoil. The flange may extend circumferentially around the inlet.

The airfoil may extend longitudinally between a leading edge and a trailing edge. The airfoil may also or alternatively extend laterally between a concave surface and a convex surface. The airfoil may include one or more cooling apertures that extend from the cavity to the leading edge. The airfoil may also or alternatively include one or more cooling apertures that extend from the cavity to the trailing edge. The airfoil may also or alternatively include one or more cooling apertures that extend from the cavity to the concave surface. The airfoil may also or alternatively include one or more cooling apertures that extend from the cavity to the convex surface.

The stator vane body may include a second cavity that extends axially from a second inlet in the body surface and into the airfoil.

The stator vane body may include a neck that extends axially between the body surface and the airfoil. The flange may extend circumferentially around and radially from the neck. The flange may be axially separated from a surface of the airfoil by a gap.

The flange may include a lip that extends circumferentially at least partially around the inlet and the shaft, and axially from a surface of the flange towards the second end. A channel may extend radially between the stator vane body and the lip.

The flange may extend from the stator vane body to a distal flange end. At least a portion of the lip may be located at the distal flange end. In addition or alternatively, one or more cooling apertures may extend axially through the flange to the channel.

The channel may extend axially between the flange and a platform surface of the first platform. The first platform may include a platform lip that extends at least partially along an edge of the vane aperture, and axially into the channel from the platform surface.

The shaft may be a first shaft. The adjustable stator vane may also include a second shaft that extends along the variable vane axis from the second end. The first shaft may be configured as or otherwise include a solid shaft. The second shaft may also or alternatively be configured as or otherwise include a solid shaft.

The stator vane body may include a neck that extends axially from the airfoil and into (e.g., partially into or through) the vane aperture. The flange may extend circumferentially around and radially from the neck. The flange may be axially separated from a surface of the airfoil by a portion of the second platform.

The second platform may be arranged within the first platform. Alternatively, the first platform may be arranged within the second platform.

The vane arrangement may include a fixed stator vane that is connected between the first platform and the second platform.

The first platform may be one of a plurality of first platforms included in an annular stator vane first platform. The second platform may be one of a plurality of second platforms included in an annular stator vane second platform. The adjustable stator vane may be one of a plurality of adjustable stator vanes that are pivotally connected to the annular stator vane first platform and the annular stator vane second platform.

The foregoing features and the operation of the invention will become more apparent in light of the following description and the accompanying drawings.

DETAILED DESCRIPTION OF THE INVENTION

Figure 1:
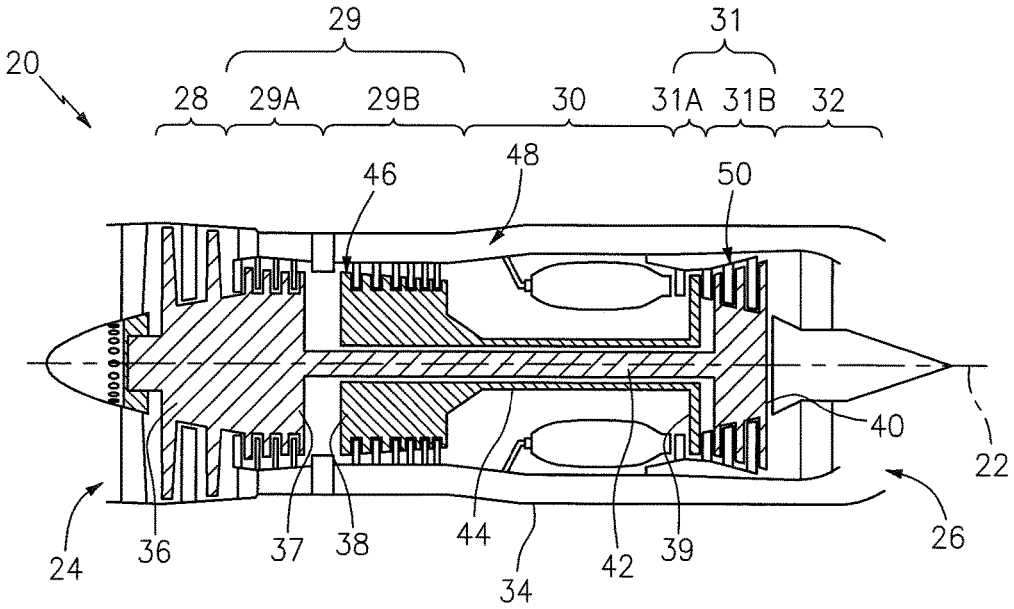
FIG. 1 is a side sectional illustration of a turbine engine.

FIG. 1 is a side sectional illustration of a turbine engine 20 that extends along an engine axis 22 between an upstream airflow inlet 24 and a downstream airflow exhaust 26. The engine 20 includes a fan section 28, a compressor section 29, a combustor section 30, a turbine section 31 and a nozzle section 32. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-32 are arranged sequentially along the axis 22 within an engine case 34.

Each of the engine sections 28, 29A, 29B, 31A and 31B includes a respective rotor 36-40. Each of the rotors 36-40 includes a plurality of rotor blades arranged circumferentially around and connected to (e.g., formed integral with or mechanically fastened, welded, brazed or otherwise adhered to) one or more respective rotor disks. The fan rotor 36 and the LPC rotor 37 are connected to and driven by the LPT rotor 40 through a low speed shaft 42. The HPC rotor 38 is connected to and driven by the HPT rotor 39 through a high speed shaft 44.

Air enters the engine 20 through the airflow inlet 24, and is directed through the fan section 28 and into an annular core gas path 46 and an annular bypass gas path 48. The air within the core gas path 46 may be referred to as "core air". The air within the bypass gas path 48 may be referred to as "bypass air". The core air is directed through the engine sections 29-32 and exits the engine 20 through the airflow exhaust 26. Within the combustor section 30, fuel is injected into and mixed with the core air and ignited to provide forward engine thrust. The bypass air is directed through the bypass gas path 48 and is utilized to provide additional forward engine thrust.

The engine 20 also includes at least one variable area vane arrangement 50 that directs the flow of core air for the turbine section 31. The variable area vane arrangement 50, for example, guides and/or adjusts the flow of the core air between adjacent rotor stages of the LPT section 31B.

Figure 2:
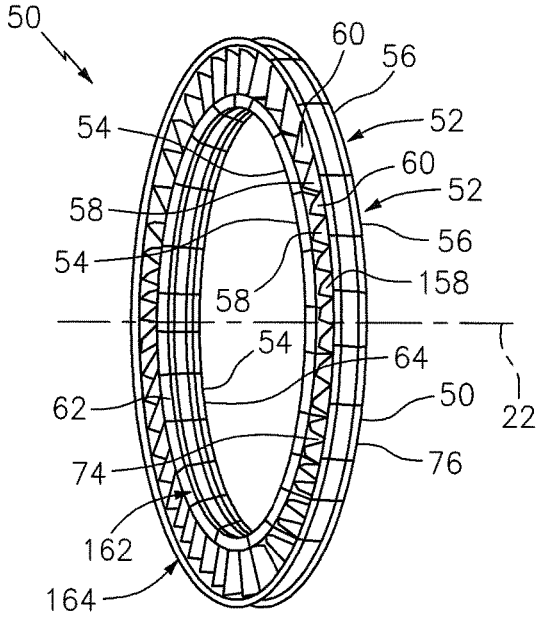
FIG. 2 is a perspective illustration of a variable area vane arrangement for the engine of FIG. 1.
Figure 3:
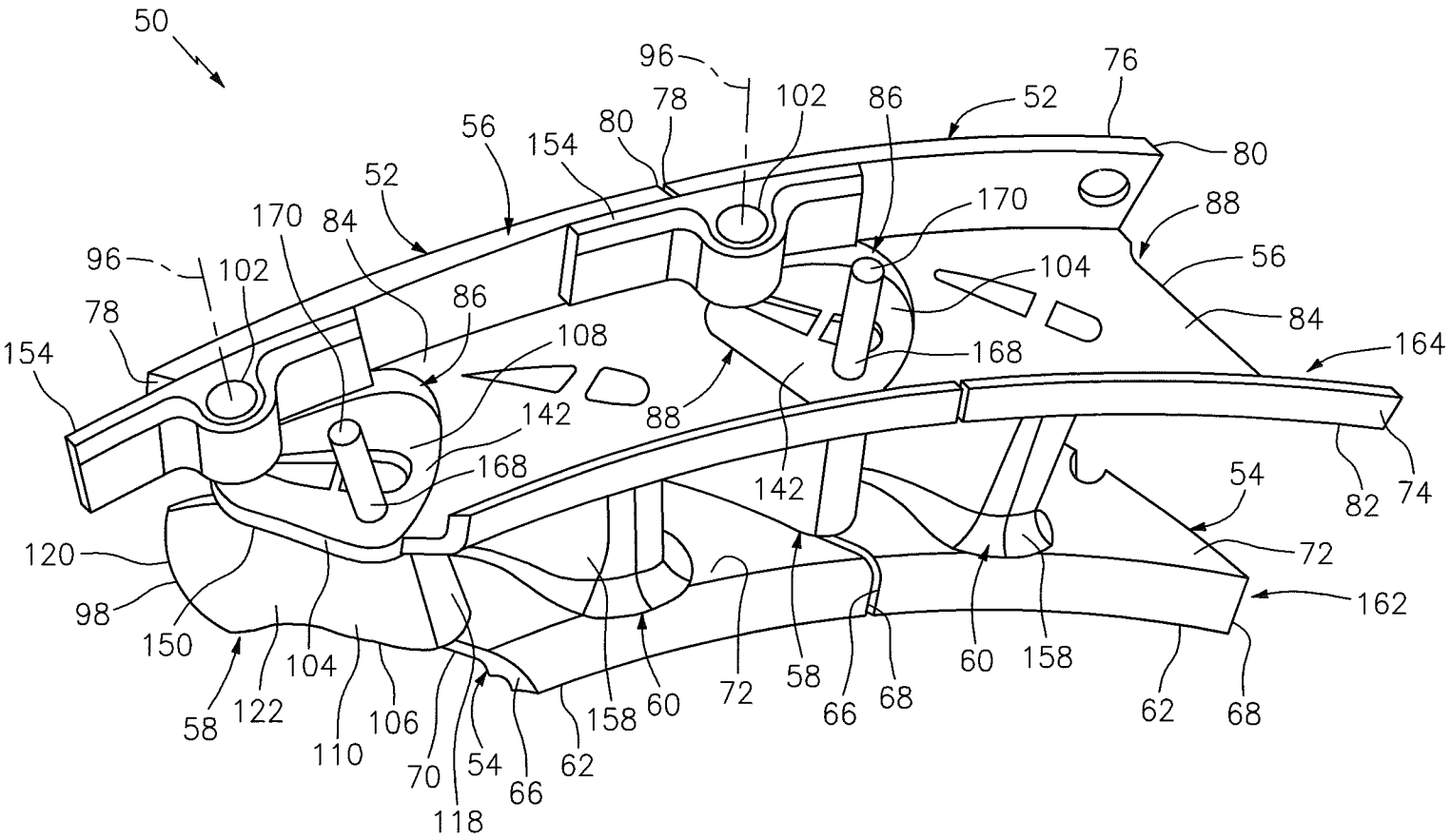
FIG. 3 is a perspective illustration of a portion of the variable area vane arrangement of FIG. 2.

FIG. 2 is a perspective illustration of the variable area vane arrangement 50 of FIG. 1. FIG. 3 is a perspective illustration of a portion of the variable area vane arrangement 50 of FIG. 2. The variable area vane arrangement 50 includes a plurality of vane arrangement segments 52. One or more of the vane arrangement segments 52 each includes a vane inner platform 54, a vane outer platform 56, and at least one adjustable stator vane 58 (e.g., a hollow adjustable stator vane). One or more of the vane arrangement segments 52 each further includes at least one fixed stator vane 60 (e.g., a hollow fixed stator vane).

The inner platform 54 extends axially relative to the axis 22 between an upstream platform end 62 and a downstream platform end 64. Referring to FIG. 3, the inner platform 54 extends circumferentially relative to the axis 22 between a first platform end 66 and a second platform end 68. The inner platform 54 extends radially relative to the axis 22 between an inner platform surface 70 and an outer platform surface 72. The outer platform surface 72 forms a portion of an inner surface of the core gas path 46 (see FIG. 1).

The outer platform 56 extends axially relative to the axis 22 between an upstream platform end 74 and a downstream platform end 76. The outer platform 56 extends circumferentially relative to the axis 22 between a first platform end 78 and a second platform end 80. The outer platform 56 extends radially relative to the axis 22 between an inner platform surface 82 and an outer platform surface 84. The inner platform surface 82 forms a portion of an outer surface of the core gas path 46 (see FIG. 1).

Figure 4:
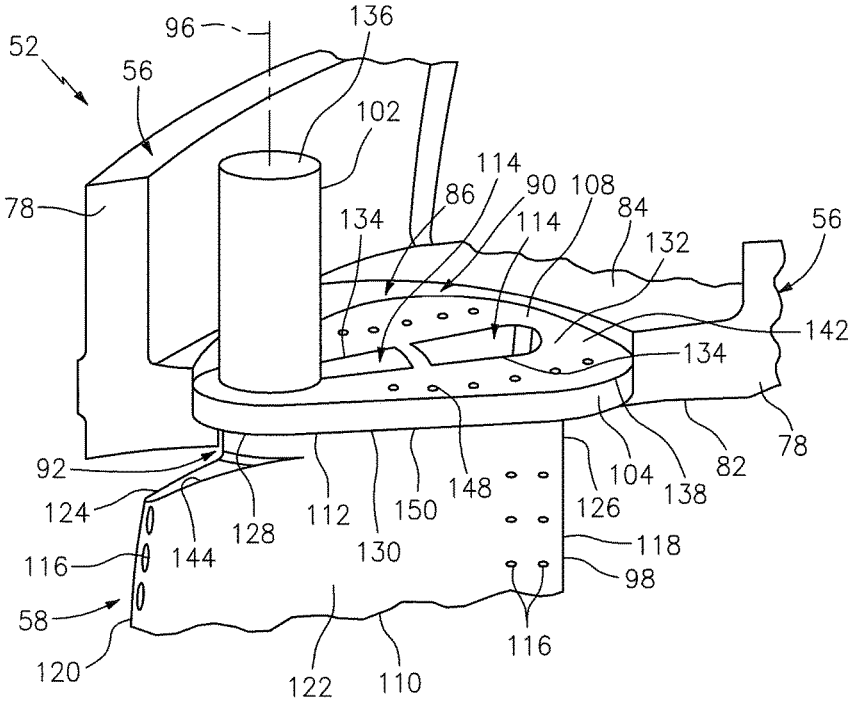
FIG. 4 is a perspective illustration of a portion of the variable area vane arrangement of FIG. 3.
Figure 5:
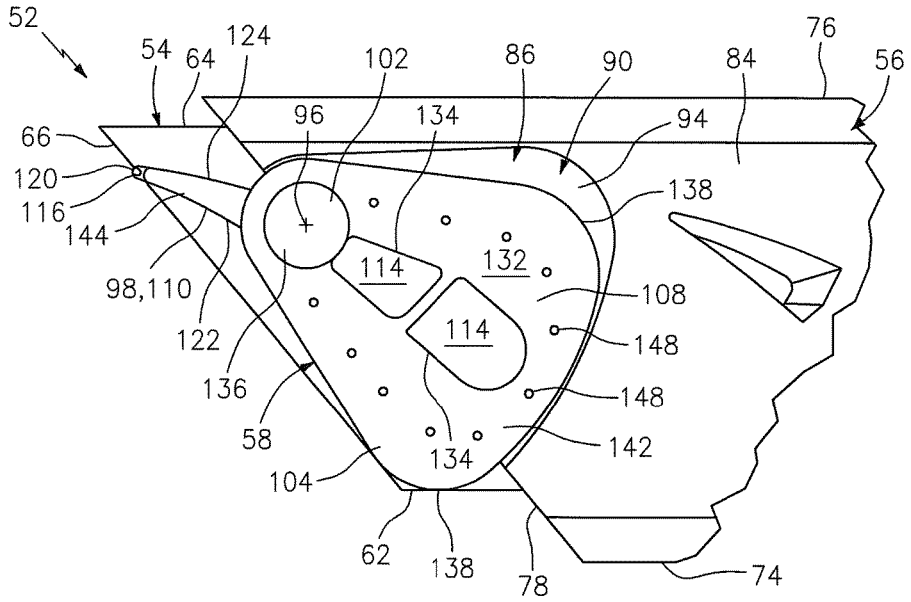
FIG. 5 is a top view illustration of a portion of the variable area vane arrangement of FIG. 3.
Figure 6:
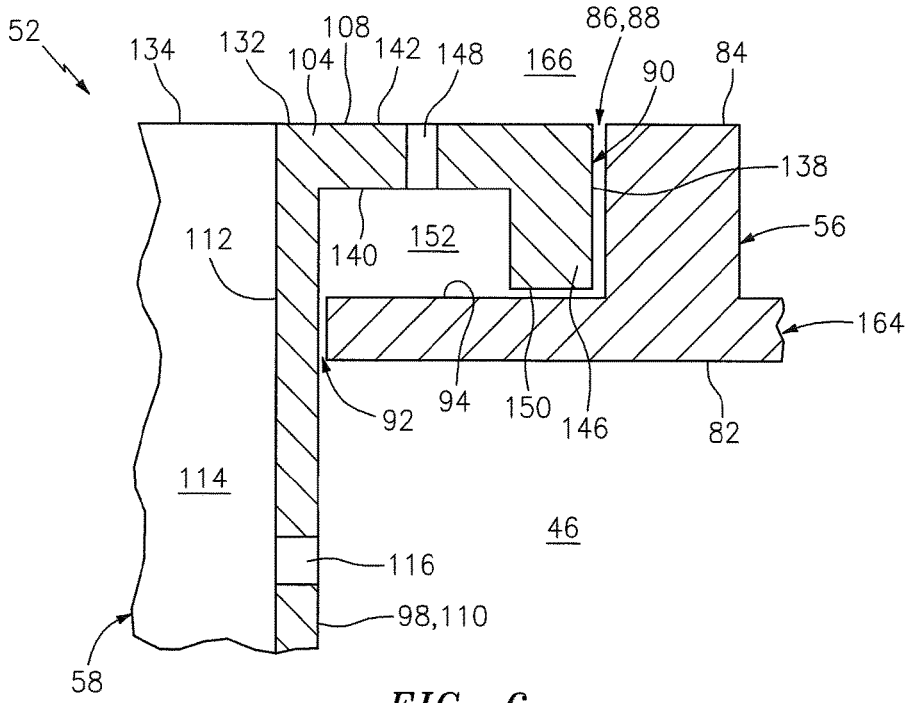
FIG. 6 is a side sectional illustration of a portion of the variable area vane arrangement of FIG. 3.

The outer platform 56 includes one or more vane apertures such as, for example, a first vane aperture 86 and a second vane aperture 88. The first vane aperture 86 is located at (e.g., on, adjacent or proximate) the first platform end 78. The second vane aperture 88 is located at the second platform end 80. One or more of the vane apertures 86 and 88 each extends radially relative to the axis 22 through the outer platform 56 between the inner platform surface 82 and the outer platform surface 84. Referring to FIGS. 4 to 6, one or more of the vane apertures 86 and 88 each includes an aperture first portion 90, an aperture second portion 92, and an aperture shelf 94. The first portion 90 extends radially from the outer platform surface 84 to the second portion 92. The second portion 92 extends radially from the inner platform surface 82 to the first portion 90. The aperture shelf 94 is defined at the intersection between the first portion 90 and the second portion 92. The aperture shelf 94 may be configured as a substantially flat, parti-annular platform surface.

Referring to FIG. 3, the adjustable stator vane 58 is adapted to pivot about a variable vane axis 96, which may extend radially relative to the axis 22. The adjustable stator vane 58 includes a stator vane body 98, one or more shafts 100 and 102 (see also FIG. 8), and a flange 104.

Figure 7:
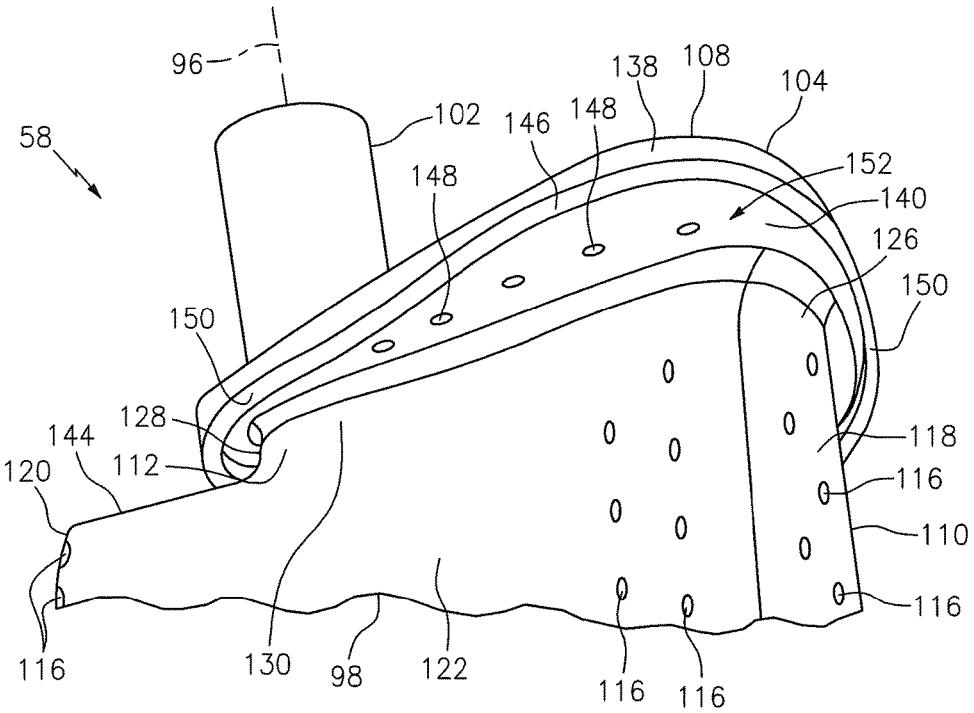
FIG. 7 is a perspective illustration of a portion of an adjustable stator vane for the variable area vane arrangement of FIG. 3.

The stator vane body 98 extends axially relative to the axis 96 (e.g., radially relative to the axis 22) between a body inner end 106 and a body outer end 108. Referring to FIGS. 4, 5 and 7, the stator vane body 98 includes an airfoil 110, a neck 112, one or more cavities 114, and one or more cooling apertures 116. The airfoil 110 extends axially relative to the axis 96 from the inner end 106 (see FIG. 3) to the neck 112. The airfoil 110 extends longitudinally between an airfoil leading edge 118 and an airfoil trailing edge 120. The airfoil 110 extends laterally between an airfoil concave surface 122 and an airfoil convex surface 124.

The neck 112 extends axially relative to the axis 96 from the airfoil 110 to the outer end 108. The neck 112 extends longitudinally between a neck leading edge 126 (e.g., the airfoil leading edge 118) and a neck trailing edge 128. The neck 112 extends laterally between a neck first surface 130 (e.g., a portion of the airfoil concave surface 122) and a neck second surface (e.g., a portion of the airfoil convex surface 124). The neck 112 includes a body surface 132 that is located at the outer end 108.

Referring to FIG. 6, one or more of the cavities 114 each extends axially relative to the axis 96 into (or through) the stator vane body 98 from a respective cavity inlet 134 in the body surface 132. One or more of the cavities 114, for example, each extends axially from the respective cavity inlet 134, through the neck 112, and into the airfoil 110.

Referring to FIGS. 4 to 7, one or more of the cooling apertures 116 each extends through the stator vane body 98 from a respective one of the cavities 114 to the airfoil leading edge 118. One or more of the cooling apertures 116 each extends through the stator vane body 98 from a respective one of the cavities 114 to the airfoil trailing edge 120. One or more of the cooling apertures 116 each extends through the stator vane body 98 from a respective one of the cavities 114 to the airfoil concave surface 122. One or more of the cooling apertures 116 each extends through the stator vane body 98 from a respective one of the cavities 114 to the airfoil convex surface 124.

Figure 8:
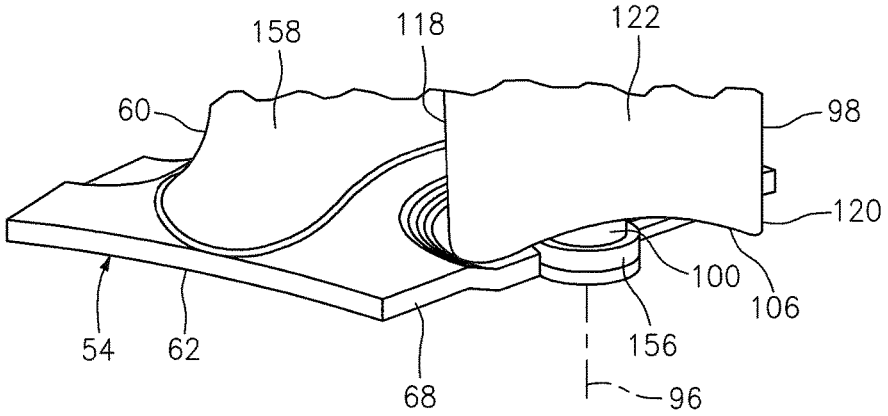
FIG. 8 is another perspective illustration of a portion of the variable area vane arrangement of FIG. 3.

Referring to FIG. 8, the inner shaft 100 (e.g., a solid shaft) is connected to the stator vane body 98 at the body inner end 106. The inner shaft 100 extends along the axis 96 from the body inner end 106. The inner shaft 100 is located a first distance from the airfoil leading edge 118. The inner shaft 100 is located a second distance from the airfoil trailing edge 120 that may be different (e.g., less) than the first distance.

Referring to FIGS. 4 and 5, the outer shaft 102 (e.g., a solid shaft) is connected to the stator vane body 98 at the body outer end 108. The outer shaft 102 extends along the axis 96 from the body surface 132 to a distal shaft end 136. The outer shaft 102 is located a first distance from the airfoil leading edge 118. The outer shaft 102 is located a second distance from the airfoil trailing edge 120 that may be different (e.g., less) than the first distance.

Referring to FIGS. 4, 5 and 7, the flange 104 is connected to the stator vane body 98 at the body outer end 108. The flange 104 extends circumferentially around one or more of the cavity inlets 134 and/or the outer shaft 102. The flange 104 extends radially relative to the axis 96 out from the stator vane body 98. The flange 104 extends radially out from, for example, the neck leading edge 126, the neck trailing edge 128, the neck first surface 130 and/or the neck second surface (e.g., a portion of the airfoil convex surface 124) to a distal flange end 138. The flange 104 extends axially relative to the axis 96 between an inner flange surface 140 and an outer flange surface 142 (e.g., the body surface 132). The inner flange surface 140 is axially separated from a surface 144 of the airfoil 110 by a gap.

Referring to FIGS. 6 and 7, the flange 104 includes a flange lip 146 and one or more cooling apertures 148. The flange lip 146 extends circumferentially substantially (or partially) around one or more of the inlets 134 and/or the outer shaft 102. The flange lip 146, for example, is located at and extends circumferentially along the distal flange end 138. The flange lip 146 extends axially relative to the axis 96 from the inner flange surface 140 towards the body inner end 106 (see FIG. 3) and to a vane surface 150. The vane surface 150 is axially separated from the airfoil surface 144 by a gap.

Referring to FIGS. 5 to 7, one or more of the cooling apertures 148 extend axially through the flange 104 between the inner flange surface 140 and the outer flange surface 142. One or more of the cooling apertures 148 are located proximate the airfoil leading edge 118. One or more of the cooling apertures 148 are located proximate the airfoil concave surface 122. One or more of the cooling apertures 148 are located proximate the airfoil convex surface 124.

Referring to FIGS. 4 to 6, the adjustable stator vane 58 is mated with the first vane aperture 86. The flange 104 is seated in the aperture first portion 90 and the vane surface 150 forms a seal with the aperture shelf 94. Referring to FIGS. 6 and 7, a cooling channel 152 extends circumferentially around the stator vane body 98 (e.g., the neck 112). The cooling channel 152 extends radially relative to the axis 96 between the stator vane body 98 (e.g., the neck 112) and the flange lip 146. The cooling channel 152 extends axially between the aperture shelf 94 and the inner flange surface 140.

Referring to FIG. 3, the inner platform 54 is arranged radially relative to the axis 22 within the outer platform 56. The airfoil 110 is arranged between and rotatably connected to the inner platform 54 and the outer platform 56. The outer shaft 102 is rotatably connected to the outer platform 56 with a bearing 154 such as, for example, a pillow block bearing or any other type of bearing or bushing. Referring to FIG. 8, the inner shaft 100 is rotatably connected to the inner platform 54 with a bearing 156 such as, for example, a cartridge bearing or any other type of bearing or bushing.

Referring to FIGS. 2 and 3, the fixed stator vane 60 includes an airfoil 158 that is arranged and extends between the inner platform 54 and the outer platform 56. The airfoil 158 is fixedly connected to (e.g., integral with) the inner platform 54 and/or the outer platform 56.

Referring to FIG. 6, each of the adjustable stator vanes 58 is mated with the second vane aperture 88. The flange 104 is seated in the aperture first portion 90 and the vane surface 150 engages the aperture shelf 94. The cooling channel 152 extends axially between the aperture shelf 94 and the inner flange surface 140.

Referring to FIGS. 2 and 3, each of the vane arrangement segments 52 is mechanically fastened, welded, brazed, adhered and/or otherwise bonded between respective adjacent vane arrangement segments 52 (or to adjacent supporting static hardware) to form the variable area vane arrangement 50. For example, each first platform end 66 is arranged adjacent to a respective second platform end 68 and each inner platform 54 is fastened to another inner platform 54, thereby forming an annular stator vane inner platform 162. Each first platform end 78 is arranged adjacent to a respective second platform end 80 and each outer platform 56 is fastened to another outer platform 56, thereby forming an annular stator vane outer platform 164.

During engine operation, one or more of the adjustable stator vanes 58 are each pivoted about its axis 96 to guide the flow of core gas through the variable area vane arrangement 50 according to a trajectory. One or more of the adjustable stator vanes 58 may also or alternatively each be pivoted about its axis 96 to adjust (e.g., increase or decrease) the flow of core gas through the variable area vane arrangement 50. Referring to FIG. 6, the vane surface 150 may respectively maintain the seal with the platform surfaces (e.g., the aperture shelves 94) during the pivoting of the respective adjustable stator vane 58. The flange 104 and the flange lip 146 therefore may reduce and/or eliminate gas leakage through the gap between the adjustable stator vane 58 and the annular stator vane outer platform 164 during the pivoting of the respective adjustable stator vane 58.

Referring to FIGS. 5 to 7, the cavity inlets 134 respectively direct cooling air from a plenum 166 adjacent the outer platform surface 84 into the cavities 114. This cooling air may be a portion of the core air that is bled from the compressor section 29 (e.g., the HPC section 29B of FIG. 1) and directed into the plenum 166 through an internal passage (not shown). The cooling apertures 116 subsequently direct the cooling air out of the airfoil 110 to cool (e.g., film cool) the airfoil concave surface 122, the airfoil convex surface 124, the airfoil leading edge 118, and/or the airfoil trailing edge 120. Where the adjustable stator vane 58 is pivoted such that the gap between a wall of the aperture second portion 92 and the airfoil 110 is small (as shown in FIG. 6), one or more of the cooling apertures 148 may direct the cooling air from the plenum 166 into the cooling channel 152 to cool (e.g., impingement cool) the aperture shelve 94. The cooling air may subsequently leak through the gap to cool (e.g., film cool) the inner platform surface 82. As the adjustable stator vane 58 pivots in the opposite direction, the gap may become larger and a portion of the inner flange surface 140 and/or one or more of the cooling apertures 148 may become exposed to the core gas path 46. The cooling apertures 148 therefore may no longer provide impingement cooling to aperture shelf 94, but may rather provide film cooling for inner platform surface 82.

Referring to FIG. 3, one or more of the adjustable stator vanes 58 may each include a vane actuation element 168 connected to the respective flange 104. The actuation element 168 may be configured as a cylindrical shaft, and extend axially from the flange outer surface 142 to a distal actuation element end 170. The distal actuation element end 170 is adapted to connect to a vane actuator (not shown) such as, for example, a unison ring. Alternatively, the actuation element may be configured as a linkage arm connected to the distal end of the outer shaft. The present invention, of course, is not limited to any particular actuation element or vane actuator configurations.

Figure 9:
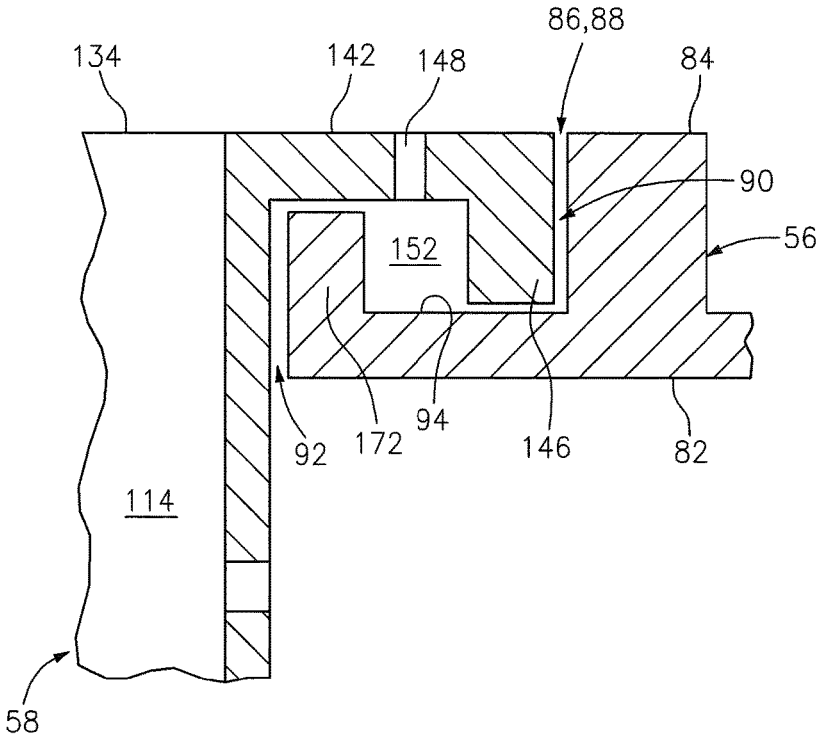
FIG. 9 is a side sectional illustration of a portion of another variable area vane arrangement for the engine of FIG. 1.

Referring to FIG. 9, in some embodiments, the outer platform 56 may include a platform lip 172 that extends substantially (or partially) along an edge of the first and/or the second vane apertures 86 and 88. The platform lip 172 extends axially relative to the axis 96 into the cooling channel 152 from the aperture shelf 94.

The shape, size, number and/or location of one or more of the cavities, cavity inlets, cooling apertures and vane apertures may vary depending upon the size and/or design of the variable area vane arrangement. For example, some or all of the cavities within a respective airfoil may be interconnected; e.g., fluidly coupled. Alternatively, the cavities within a respective airfoil may be fluidly separate. One or more of the cavity inlets and/or the cooling apertures may have elongated (e.g., rectangular, oval, elliptical, etc.) cross-sectional geometries. One or more of the cavity inlets and/or the cooling apertures may alternatively have circular cross-sectional geometries. One or more of the cavity inlets and/or the cooling apertures may have flared geometries. The second vane apertures may be omitted, and the first vane aperture may be located between the first and the second platform ends. The present invention therefore is not limited to any particular cavity and/or cavity inlet or cooling aperture quantities or configurations.

The adjustable stator vane 58 and the fixed stator vane 60 may have various configurations other than those described above and illustrated in the drawings. For example, the adjustable stator vane may be configured with a solid airfoil. The neck may be omitted, and the flange may extend radially out from the airfoil. One or more of the adjustable stator vanes may each be configured as a unitary body; e.g., the stator vane body, the flange, the inner shaft and the outer shaft may be cast, machined, milled and/or otherwise formed integral with one another. Alternatively, one or more of the adjustable stator vanes may each be configured from a plurality of discrete vane segments, which are mechanically fastened, welded, brazed, adhered and/or otherwise bonded together. The fixed stator vane may be configured with a solid airfoil. The present invention therefore is not limited to any particular adjustable stator vane or the fixed stator vane configurations.

The terms "upstream", "downstream", "inner" and "outer" are used to orient the components of the variable area vane arrangement 50 described above relative to the turbine engine 20 and its axis 22. A person of skill in the art will recognize, however, one or more of these components may be utilized in orientations other than those described above. For example, the flange may be connected to the stator vane body at the body inner end, and the inner platform may include the vane apertures. The present invention therefore is not limited to any particular variable area vane arrangement spatial orientations.

The variable area vane arrangement 50 described above may be utilized to direct the flow of air through an engine section other than the LPT section 31B as described above. For example, the variable area vane arrangement 50 may direct the flow of core air into rotor stages of the HPT section 31A, or between the HPT section 31A and the LPT section 31B. Alternatively, the variable area vane arrangement 50 may direct the flow of air into or between adjacent rotor stages of one of the engine sections 28, 29A and 29B, or any other section of the engine 20.

A person of skill in the art will recognize the variable area vane arrangement 50 may be included in various turbine engines other than the one described above. The variable area vane arrangement 50, for example, may be included in a geared turbine engine where a gear train connects one or more shafts to one or more rotors in a fan section, a compressor section and/or any other engine section. Alternatively, the variable area vane arrangement 50 may be included in a turbine engine configured without a gear train.

The variable area vane arrangement 50 may be included in a geared or non-geared turbine engine configured with a single spool, with two spools (e.g., see FIG. 1), or with more than two spools. The variable area vane arrangement 50 may be included in a turbine engine with a single flow path (e.g., stream), with two flow paths (e.g., see FIG. 1), or more that two flow paths. The turbine engine may be configured as a turbofan engine, a turbojet engine, a propane engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An adjustable stator vane for a turbine engine, comprising:

a stator vane body that pivots about a variable vane axis, the stator vane body extending axially between a first end and a second end, and including
an airfoil;
a body surface located at the first end; and
a cavity extending axially from an inlet in the body surface and into the airfoil;

a shaft extending along the variable vane axis from the first end; and a flange extending circumferentially around the inlet and the shaft, and radially from the stator vane body; and a lip extending circumferentially at least partially around the inlet and the shaft, and axially from a surface of the flange towards the second end;

wherein a channel extends radially between the stator vane body and the lip.

2. The adjustable stator vane of claim 1, wherein the airfoil extends longitudinally between a leading edge and a trailing edge; and the airfoil extends laterally between a concave surface and a convex surface.

3. The adjustable stator vane of claim 2, wherein the airfoil includes a cooling aperture that extends from the cavity to one of the leading edge, the trailing edge, the concave surface and the convex surface.

4. The adjustable stator vane of claim 1, wherein the stator vane body further includes a second cavity that extends axially from a second inlet in the body surface and into the airfoil.

5. The adjustable stator vane of claim 1, wherein the stator vane body further includes a neck that extends axially between the body surface and the airfoil;

the flange extends circumferentially around and radially from the neck; and the flange is axially separated from a surface of the airfoil by a gap.

6. The adjustable stator vane of claim 1, wherein the flange extends from the stator vane body to a distal flange end; and at least a portion of the lip is located at the distal flange end.

7. The adjustable stator vane of claim 1, wherein a cooling aperture extends axially through the flange to the channel.

8. The adjustable stator vane of claim 1, wherein the shaft comprises a solid shaft.

9. The adjustable stator vane of claim 1, further comprising a second shaft extending along the variable vane axis from the second end.

10. An adjustable stator vane for a turbine engine, comprising:

a stator vane body that pivots about a variable vane axis, the stator vane body extending axially between a first end and a second end, and including an airfoil;

a shaft connected to the stator vane body at the first end, the shaft extending along the variable vane axis; and a flange connected to the stator vane body at the first end, the flange extending circumferentially around the shaft, and radially from the stator vane body;

wherein the flange is axially separated from a surface of the airfoil by a gap.

11. The adjustable stator vane of claim 10, wherein the stator vane body further includes a body surface and a cavity;

the body surface is located at the first end;

the cavity extends axially from an inlet in the body surface and into the airfoil; and the flange extends circumferentially around the inlet.

12. A variable area vane arrangement, comprising:

a vane first platform including a vane aperture;

a vane second platform; and an adjustable stator vane that pivots about a variable vane axis, the adjustable stator vane including a stator vane body extending axially at least partially into the vane aperture and between a first end and a second end, the stator vane body including an airfoil arranged between the first platform and the second platform;

a first shaft extending along the variable vane axis from the first end, and rotatably connected to the first platform;

a second shaft extending along the variable vane axis from the second end, and rotatably connected to the second platform; and a flange extending circumferentially around the first shaft, and radially from the stator vane body;

wherein the flange further includes a lip that extends circumferentially at least partially around the inlet and the shaft, and axially from a surface of the flange towards the second end; and wherein a channel extends axially between the flange and the first platform, and radially between the stator vane body and the lip.

13. The vane arrangement of claim 12, wherein the stator vane body further includes a body surface and a cavity;

the body surface is located at the first end;

the cavity extends axially from an inlet in the body surface and into the airfoil; and the flange extends circumferentially around the inlet.

14. The vane arrangement of claim 12, wherein the stator vane body further includes a neck that extends axially from the airfoil and at least partially into the vane aperture;

the flange extends circumferentially around and radially from the neck; and the flange is axially separated from a surface of the airfoil by a portion of the second platform.

15. The vane arrangement of claim 12, wherein the channel extends axially between the flange and a platform surface of the first platform; and the first platform further includes a platform lip that extends at least partially along an edge of the vane aperture, and axially into the channel from the platform surface.

16. The vane arrangement of claim 12, wherein the second platform is arranged within the first platform.

17. The vane arrangement of claim 12, further comprising a fixed stator vane connected to the first platform and the second platform.

18. The vane arrangement of claim 12, wherein the first platform is one of a plurality of first platforms included in an annular stator vane first platform;

the second platform is one of a plurality of second platforms included in an annular stator vane second platform; and the adjustable stator vane is one of a plurality of adjustable stator vanes that are pivotally connected to the annular stator vane first platform and the annular stator vane second platform.

19. The adjustable stator vane of claim 10, further comprising:

an annular lip extending circumferentially around the inlet and the shaft;

the annular lip extending axially away from a surface of the flange towards the second end; and an annular channel extending radially between the stator vane body and the annular lip.

* * * * *